United States Patent [19]

Nakamura et al.

[11] 4,391,852

[45] Jul. 5, 1983

[54] PROCESS FOR PREPARING AN ACCEPTOR COATED SHEET

[75] Inventors: Mikio Nakamura; Makoto Miyake, both of Hyogo, Japan

[73] Assignee: Kanzaki Paper Manufacturing Co., Ltd., Tokyo, Japan

[21] Appl. No.: 356,532

[22] Filed: Mar. 9, 1982

[30] Foreign Application Priority Data

Mar. 19, 1981 [JP] Japan ..... 56-40893

[51] Int. Cl.[3] ..... B41M 3/12

[52] U.S. Cl. ..... 427/150; 282/27.5; 427/151

[58] Field of Search ..... 427/150, 151; 428/914; 282/27.5

[56] References Cited

U.S. PATENT DOCUMENTS

| | | | |
|---|---|---|---|
| 3,554,781 | 1/1971 | Matsukawa et al. | 427/150 |
| 3,900,216 | 8/1975 | Hayashi et al. | 427/150 |
| 3,955,026 | 5/1976 | Matsukawa et al. | 427/150 |
| 4,020,261 | 4/1977 | Oda et al. | 427/150 |
| 4,046,941 | 9/1977 | Saito | 427/150 |

*Primary Examiner*—Norman Morgenstern
*Assistant Examiner*—Janyce A. Bell
*Attorney, Agent, or Firm*—Morgan, Finnegan, Pine, Foley & Lee

[57] ABSTRACT

In a process for preparing an acceptor coated sheet used in a pressure sensitive copying system utilizing a color forming reaction on a base sheet between the color former in the form of the oily core material encapsulated in microcapsules and the acceptor in an acceptor layer formed on said base sheet, the base sheet is coated with a composition comprising at least one acceptor and an aqueous emulsion of an oligomer of a hydrocarbon compound having 3 to 10 carbon atoms in total.

4 Claims, No Drawings

PROCESS FOR PREPARING AN ACCEPTOR COATED SHEET

BACKGROUND OF THE INVENTION

This invention relates to a pressure sensitive copying system and more particularly to pressure sensitive copying paper having a good color formability and an improved printability.

Usually the so-called "pressure sensitive copying system" consists of these three kinds of basic sheets such as top sheet, middle sheet and bottom sheet, wherein the top sheet is coated on the underside thereof with a composition consisting mainly of pressurerupturable microcapsules each enclosing an oily core material containing an electron donating organic chromogenic material (hereinafter referred to as "color former") dissolved or dispersed therein, the middle sheet is coated on the upperside thereof with another composition consisting mainly of electron accepting acidic reactant material (hereinafter referred to as "acceptor") which will produce a colored image when contact with the color former and also is coated on the underside thereof with the composition of microcapsules containing oil droplets in which a color former is dissolved or dispersed and the bottom sheet is coated on the upperside thereof with the composition of acceptor. One top sheet and one bottom sheet or, one top sheet, at least one middle sheet and one bottom sheet are superposed in that order to form a set of copying sheet in such a manner that the microcapsule coating layer and the acceptor coating layer are in contact with each other in each adjoining two sheets. Any partial pressing on the upperside of the top sheet of the thus prepared copying system with a pen or a typewriter will break the microcapsules positioned on the pressing, resulting in making the color former react with the acceptor so as to develop a color only on the part pressed.

In another pressure sensitive copying system, there are disposed on one surface of the same sheet both the acceptor and the microcapsules containing oil droplets in which the color former is dissolved or dispersed. The system is known as the "self contained" system.

The term "oily core material" described means the oil material which is enclosed in each color former microcapsule and comprises a non-volatile oil, a color former dissolved or dispersed in said non-volatile oil and other various additives which may be added when required. The color former microcapsules may be produced by any conventional method e.g., by the "coacervation" technique, by the "interfacial polymerization" technique or by the "in-situ polymerization" technique.

Among known color former compounds there are included triarylmethane compounds such as 3,3-bis(p-dimethylaminophenyl)-6-dimethylaminophthalide (CVL), 3,3-bis(p-dimethylaminophenyl)phthalide, 3-(p-dimethylaminophenyl)-3-(1,2-dimethylindole-3-yl)phthalide and 3-(p-dimethylaminophenyl)-3-(2-methylindole-3-yl)phthalide, diphenylmethane compounds such as 4,4'-bis-dimethylaminobenzhydrylbenzylether, N-halophenyl-leucoauramine and N-2,4,5-trichlorophenyl-leucoauramine, xanthene compounds such as rhodamine-B-anilinolactam, rhodamine(p-nitroanilino)lactam, rhodamine(o-chloroanilino)lactam, 7-dimethylamino-2-methoxyfluoran and 7-diethylamino-2-methoxyfluoran, thiazine compounds such as benzoyl-leucomethyleneblue and p-nitrobenzoyl-leucomethyleneblue, spiro compounds such as 3-methyl-spiro-dinaphtopyran, 3-ethyl-spirodinaphthopyran, 3-phenyl-spiro-dinaphthopyran, 3-benzyl-spiro-dinaphthopyran, 3-methyl-naphtho-(6'-methoxybenzo)spiropyran, and 3-propyl-spiro-dibenzopyran.

Among known acceptors there are included inorganic acceptors such as acid clay, activated clay, attapulgite, zeolite, bentonite, silica and aluminum silicate; and organic acceptors such as phenol polymers, e.g., phenol-aldehyde polymers and phenol-acetylene polymers, aromatic carboxylic acids and polyvalent metal salts thereof.

Usually, the acceptor coated sheet is produced by coating a base sheet with a coating composition which comprises an aqueous dispersion of an acceptor and a binder. Among known binders there are included natural binder such as starch and casein; and synthetic binder such as polyvinylalcohol, carboxymethylcellulose, styrene-butadiene copolymer latex and acrylic acid copolymer latex.

The acceptor and the binder have antinomic functions with respect to the color formability and the printability. Namely, if a binder is used in a large amount in order to provide coating layer with a good surface strength so that "picking" at the time of printing can be prevented, the acceptor coated sheet shows a poor color formability. On the contrary, if the amount of a binder used is decreased to ensure a good color formability, the printing speed must be reduced in order to prevent "picking" during the printing operation.

An attempt has been made to improve the color formability of an inorganic acceptor coated sheet by utilizing in acceptor coating composition an aqueous emulsion of an oily material such as olive oil, fish oil, paraffin oil, chlorinated diphenyl, silicone oil, benzene and fluorinated and chlorinated ethylene, as disclosed in Japanese Patent Publication No. 13,165 of 1971.

Though the utilization of the aqueous emulsions of the kind disclosed therein can certainly improve the color formability of the acceptor coated sheet, it can not prevent the surface strength of the acceptor coated sheet from being decreased.

The principal object of the invention is to provide an improved acceptor coated sheet for a pressure sensitive copying system in which both the color formability and the printability are improved without sacrificing each other.

Another object of the invention is to provide an improved acceptor coating composition which includes a binder in a relatively small amount.

Other objects and advantages of the invention will be apparent from the following descriptions.

SUMMARY OF THE INVENTION

According to the invention both the color formability and the printability are improved by utilizing in an acceptor coating composition an aqueous emulsion of an oligomer of a hydrocarbon compound having 3 to 10 carbon atoms in total.

The word "oligomer" described means a polymer having a relatively low morecular weight which keep liquefied at the normal temperature. Addition of an aqueous emulsion of a specified hydrocarbon compound to an acceptor coating composition unexpectedly and remarkably improves both the color formability and the surface strength of the acceptor coated sheet. As a result of enhancement of the surface strength the amount of a binder used in the acceptor coating composition can be reduced. This also result in further more enhancing the color formability.

DETAILED DESCRIPTION OF THE INVENTION

The invention is applied to the pressure sensitive copying system in which a color forming reaction can occur, on a base sheet, between the color former in the form of the oily core material encapsulated in microcapsules and the acceptor included in an acceptor coating layer.

The color former microcapsules and the acceptor may be disposed on the surfaces of different sheets or on one surface of the same sheet. In the latter case, both the color former microcapsules and the acceptor may also be included either in the respective different coating layers or on a single coating layer on a base sheet.

Any known color former compounds for pressure sensitive copying paper may be used for the invention.

The acceptor used for the invention may also be at least one of various known acceptor compounds. Preferably the acceptor may be an inorganic acceptor.

The specific oligomer used for the invention is at least one of homopolymers or copolymers of a hydrocarbon compounds having 3 to 10 carbon atoms in total, such as propylene, butadiene, butene, isobutylene, isoprene, pentadiene, hexadiene, styrene and methylstyrene. More specifically, among the useful oligomers for the invention those are included homopolymers such as liquid polypropylene, polybutadiene, polybutene, polyisobutylene, polyisoprene, polypentadiene, polyhexadiene and oligostyrene; and copolymers such as isobutyleneisoprene copolymer (liquid butyl rubber), butene-butadiene copolymer and butene-isobutylene copolymer. These compounds may be used solely or in combination.

Those oligomers may be modified, as by carboxylation, to enhance the mechanical stability.

The oligomers of a hydrocarbon compound having two or less hydrocarbons or 11 or more hydrocarbons can not attain the objects of the invention. Preferably the oligomers may be ones having a molecular weight smaller than 5000 which keep liquefied at the normal temperature. Among those oligomers there are included polybutene, polybutadiene, polyisobutylene and polypentadiene.

The aqueous emulsion of a oligomer of such a kind as described in the above may be prepared by emulsifying an oligomer into water utilizing a homomixer or an ultrasonic emulsifier.

The amount of the aqueous emulsion of an oligomer of the specified kind added to the acceptor coating composition may be changed in accordance with the kind of the acceptor used. Preferably, it may be within the range of 2 to 20 parts by weight in solid content per 100 parts by weight of the acceptor used in solid content (non-volatile component content).

In order to enhance the color formability the acceptor coating composition may include alkali metal compounds such as lithium hydroxide, sodium hydroxide, potassium hydroxide, sodium carbonate, sodium silicate and sodium aluminate, alkaline earth metal compounds such as magnesium oxide, calcium oxide, magnesium hydroxide and calcium carbonate, and the other alkaline compounds such as ammonia and amines.

It is also optional to use any other conventional auxiliry agents for the acceptor coating composition.

Any conventional devises may be used for preparing the coating composition. Any conventional coating technique may also be used for the formation of the acceptor coating layer. For this purpose any of an air knife coater, a blade coater, a bar coater, a roll coater, a size press coater and a curtain coater may be used at will. The amount of the coating composition applied is not limited to any specified range but may be within the conventionally acceptable range.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively.

EXAMPLE 1

20 parts of polybutadiene having a molecular weight of 2000 (Nisseki Polybutadiene B-2000 manufactured by Nippon Petrochemical Company Ltd.) was added to a solution consisting of 50 parts of water and 10 parts of 10% aqueous solution of polyvinylalcohol. The mixture was emulsified in an ultrasonic emulsifier to prepare a polybutadiene emulsion having an average particle size of 0.5 microns.

10 parts of 20% aqueous solution of sodium hydroxide was added to 300 parts of water. To the resultant aqueous solution, 100 parts of activated clay (Silton manufactured by Mizusawa Kagaku Kogyo Kabushiki Kaisha) was dispersed to obtain a slurry. A styrene-butadiene copolymer latex (Dow Latex 620 manufactured by Asahi-Dow Limited) was added to the slurry in the weight of an amount of 20 parts on dry basis and then the above polybutadiene emulsion was added to it in the weight of an amount of 4 parts on dry basis to prepare an acceptor coating composition.

The coating composition was coated on a surface of a paper sheet of 40 g/m$^2$ in the weight of an amount of 7 g/m$^2$ on dry basis with a coating rod and after drying the coated paper sheet was super-calendered to obtain an acceptor coated paper sheet for pressure-sensitive record paper.

EXAMPLE 2

Example 1 was repeated except that a polybutene emulsion in which polybutene has a molecular weight of 570 (Nisseki Polybutene Emulsion HE 175 manufactured by Nippon Petrochemical Company Ltd.) was used instead of the polybutadiene emulsion to obtain an acceptor coated paper sheet.

EXAMPLE 3

Example 1 was repeated except that polyisoprene having a molecular weight of 4000 was used instead of polybutadiene to obtain an acceptor coated paper sheet.

EXAMPLE 4

Example 1 was repeated except that polypentadiene having a molecular weight of 1000 (Quintol B-1000 manufactured by Nippon Zeon Co., Ltd.) was used instead of polybutadiene to obtain an acceptor coated paper sheet.

EXAMPLE 5

An acceptor coated paper sheet was prepared in the same manner as in Example 1 except that a polybutene emulsion in which polybutene has a molecular weight of 570 (Nisseki Polybutene Emulsion HE 175 manufactured by Nippon Petrochemical Company Ltd.) was used in the weight of an amount of 15 parts on dry basis instead of the polybutadiene emulsion and the styrene-butadiene copolymer latex was added in the weight of an amount of 16 parts on dry basis.

EXAMPLE 6

10 parts of 20% aqueous solution of potassium hydroxide was added to 100 parts of water and then 30 parts of calcium carbonate and 70 parts of an activated clay (Silton manufactured by Mizusawa Kagaku Kogyo Kabushiki Kaisha) were dispersed in it. To the resultant slurry a styrene-butadiene copolymer latex (Dow Latex 620 manufactured by Asahi-Dow Limited) was added as a binder in the weight of an amount of 15 parts on dry basis and then a polybutene emulsion in which polybutene has a molecular weight of 570 (Nisseki Polybutene Emulsion HE 175 manufactured by Nippon Petrochemical Company Ltd.) was added to it in the weight of an amount of 6 parts on dry basis to prepare an acceptor coating composition.

The coating composition was coated on a surface of a paper sheet of 40 g/m$^2$ in the weight of an amount of 6 g/m$^2$ on dry basis with a blade coater and after drying the coated paper sheet was super-calendered to prepare an acceptor coated paper sheet for pressure-sensitive copying paper.

EXAMPLE 7

800 parts of α-methylstyrene polymer having a molecular weight of 1100 and a softening point of 110° C. was heated at 180° C. to obtain a melt. To the melt 800 parts of zinc 3,5-di(α-methylbenzyl)salicylate was added to obtain a homogeneous mixture. The mixture was cooled to solidify and then pulverized. 5000 parts of water, 10 parts of sodium butylnaphthalene-sulfonate (Pelex NBL manufactured by Kao Atras Kabushiki Kaisha) and 250 parts of 10% aqueous solution of polyvinylalcohol were added to the pulverized mixture. The mixture was further finely divided in a sand mill of continuous type to prepare an acceptor dispersion of salicylic acid type having a solid content of 25%.

5 parts of 20% aqueous solution of potassium hydroxide was added to 100 parts of water. To the resultant aqueous solution, 25 parts of zinc oxide and 70 parts of activated clay (Silton manufactured by Mizusawa Kagaku Kogyo Kabushiki Kaisha) were dispersed and then the above acceptor dispersion was added in the weight of an amount of 5 parts on dry basis to prepare a slurry. A styrene-butadiene copolymer latex (Dow Latex 620 manufactured by Asahi-Dow Limited) was added in the weight of an amount of 15 parts on dry basis to the slurry and then an emulsion of polybutene having a molecular weight of 570 (Nisseki Polybutene Emulsion HE 175 manufactured by Nippon Petrochemical Company Ltd.) was added in the weight of an amount of 6 parts on dry basis to prepare an acceptor coating composition.

The coating composition was coated on a surface of a paper sheet of 40 g/m$^2$ in the weight of an amount of 6 g/m$^2$ on dry basis by a blade coater. After drying the coated paper sheet was super-calendered to produce an acceptor coated paper sheet for pressure-sensitive copying paper.

EXAMPLE 8

10 parts of sodium butylnaphthalenesulfonate (Pelex NBL manufactured by Kao Atras Kabushiki Kaisha), 250 parts of 10% aqueous solution of polyvinylalcohol and 1600 parts of p-phenylphenol resin were added to 5000 parts of water. The mixture was pulverized in a sand mill of continuous type to prepare an acceptor dispersion of phenol type having a solid content of 25%.

5 parts of 20% aqueous solution of potassium hydroxide was added to 100 parts of water. To the mixture 25 parts of zinc oxide and 70 parts of activated clay (Silton manufactured by Mizusawa Kagaku Kogyo Kabushiki Kaisha) were dispersed and then the above acceptor dispersion was added in the weight of an amount of 5 parts on dry basis. To the resultant slurry a styrene-butadiene copolymer latex (Dow Latex 620 manufactured by Asahi-Dow Limited) was added in the weight of an amount of 15 parts on dry basis and then an emulsion of polybutene having a molecular weight of 570 (Nisseki Polybutene Emulsion HE 175 manufactured by Nippon Petrochemical Company Ltd.) was added in the weight of an amount of 6 parts on dry basis to prepare an acceptor coating composition.

The coating composition was coated on a surface of a paper sheet of 40 g/m$^2$ in the weight of an amount of 6 g/m$^2$ on dry basis with a blade coater. After drying the coated paper sheet was super-calendered to obtain an acceptor coated paper sheet.

Control 1.

Example 1 was repeated except that polybutadiene was not added to the coating composition to obtain an acceptor coated paper sheet.

Control 2.

Example 1 was repeated except that a liquid paraffin emulsion (Cerosol 837 manufactured by Chukyo Ushi Kabushiki Kaisha) was used instead of the polybutadiene emulsion to obtain an acceptor coated paper sheet.

Control 3.

Example 1 was repeated except that a silicone oil (SH 1107 manufactured by Toray Silicone Kabushiki Kaisha) was used instead of polybutadiene to obtain an acceptor coated paper sheet.

Control 4.

Example 1 was repeated except that benzene was used instead of polybutadiene to obtain an acceptor coated paper sheet.

Control 5.

Example 6 was repeated except that the polybutene emulsion was not added in the coating composition to obtain an acceptor coated paper sheet.

Control 6.

An acceptor coated paper sheet was prepared in the same manner as in Example 6 except that an emulsion of fluorinated and chlorinated polyethylene (Daifloyl #3 manufactured by Daikin Kogyo Co., Ltd.) was used instead of the polybutene emulsion and the styrene-butadiene copolymer latex was used in the weight of a more amount on dry basis than Example 6 by 4 parts.

Control 7.

Example 6 was repeated except that an emulsion of polyethylene having a molecular weight about 2000 (Polylene K-20 manufactured by Daikyo Kagaku Kabushiki Kaisha) was used instead of the polybutene emulsion to obtain an acceptor coated paper sheet.

Control 8.

Example 7 was repeated except that the polybutene emulsion was not used to obtain an acceptor coated paper sheet.

Control 9.

Example 8 was repeated except that the polybutene emulsion was not added to obtain an acceptor coated paper sheet.

The properties of thus obtained seventeen acceptor coated paper sheets were examined by the following method and the results are shown in Table 1.

(1) Color Density:

A capsule coated paper sheet in which microcapsules contain an oily solution of crystal violet lactone (CVL) was put on the acceptor coated paper sheet in the manner as the capsule coating layer was faced on the acceptor coating layer. The laminated material was pressed with 100 kg/cm$^2$ to form a color image. The color density of the image was measured by a spectrophotometer at 610 m$\mu$.

(2) Surface Strength:

The acceptor coated paper sheet was printed by RI printing test machine (RI Testor manufactured by Akira Seisakusho) with a high tack ink. The appearance of picking on the surface of the acceptor coating layer was examined with the naked eye.

TABLE 1

| | Color Density (absorbance) | Surface Strength (printability) |
|---|---|---|
| Example 1 | 1.22 | |
| Example 2 | 1.23 | |
| Example 3 | 1.18 | |
| Example 4 | 1.22 | |
| Example 5 | 1.20 | |
| Example 6 | 1.04 | |
| Example 7 | 1.10 | |
| Example 8 | 1.09 | |
| Control 1 | 0.70 | |
| Control 2 | 1.18 | X |
| Control 3 | 0.80 | X |
| Control 4 | 0.75 | X |
| Control 5 | 0.65 | |
| Control 6 | 0.85 | |
| Control 7 | 0.63 | |
| Control 8 | 0.75 | |
| Control 9 | 0.73 | |

Picking does not substantially appear.
A little picking appears but it is not a practical problem.
X A heavy picking appears and a good printing can not be obtained.

What we claim is:

1. In a process for preparing an acceptor coated sheet used in a pressure sensitive copying system utilizing a color forming reaction on a base sheet between the color former in the form of the oily core material encapsulated in microcapsules and the acceptor in an acceptor layer formed on said base sheet, the improvement which comprises coating said base sheet with a composition comprising at least one acceptor and an aqueous emulsion of an oligomer of a hydrocarbon compound having 3 to 10 carbon atoms in total and selected from the group consisting of liquid polypropylene, polybutadiene, polybutene, polyisobutylene, polyisoprene, polypentadiene, polyhexadiene, oligostyrene, isobutylene-isoprene copolymer, butene-butadiene copolymer, butene-isobutylene copolymer, and mixtures thereof, said oligimer being liquid at the normal temperature.

2. A process according to claim 1, in which said oligomer has a molecular weight not larger than 5000.

3. A process according to claim 1, in which said aqueous emulsion of an oligomer is included in said composition in an amount within the range of 2 to 20 parts by weight in solid content per 100 parts by weight of solid content of said acceptor.

4. A process according to claim 3, in which said acceptor is an inorganic acceptor.

* * * * *